US005630572A

United States Patent [19]

Guay

[11] Patent Number: 5,630,572

[45] Date of Patent: May 20, 1997

[54] RETRACTABLE FENCE SYSTEM FOR SWIMMING POOL OR THE LIKE

[76] Inventor: Claude Guay, 4479 Marie-Victorin, St-Antoine-de-Tilly, Québec, Canada, G0S 2C0

[21] Appl. No.: 555,315

[22] Filed: Nov. 8, 1995

[51] Int. Cl.[6] ..... E04H 4/06

[52] U.S. Cl. ..... 256/1; 256/25; 256/DIG. 2; 4/496

[58] Field of Search ..... 256/1, 24, 25, 256/23, 73, DIG. 2; 4/494, 496, 504

[56] References Cited

U.S. PATENT DOCUMENTS

| | | | |
|---|---|---|---|
| 1,884,447 | 10/1932 | White | 256/1 |
| 3,045,253 | 7/1962 | Price | 4/504 |
| 3,086,219 | 4/1963 | Stafford | 4/504 X |
| 3,094,710 | 6/1963 | Hoke | 4/494 |
| 3,227,422 | 1/1966 | Loeb | 256/1 |
| 3,566,420 | 3/1971 | Peterson et al. | 4/494 |
| 3,766,691 | 10/1973 | Ray | 4/494 X |
| 4,271,542 | 6/1981 | Wood et al. | 4/494 X |
| 4,466,143 | 8/1984 | Lamb | 4/504 X |
| 5,102,103 | 4/1992 | Putnam | 256/25 X |
| 5,168,584 | 12/1992 | Peebles | 256/25 X |

FOREIGN PATENT DOCUMENTS

| | | | |
|---|---|---|---|
| 2607173 | 5/1988 | France | 4/494 |
| 221506 | 9/1990 | Japan | 256/DIG. 2 |

*Primary Examiner*—Harry C. Kim

[57] ABSTRACT

The fence system includes a trench and a collapsible screen which is mounted in the trench. A lifting device engages the top of the screen and the latter in fixed inside the trench. The lifting device is designed to raise the top of the screen to an extended position at a predetermined height, and also to lower it to a retracted position inside the trench. A closure is provided which closes the trench when the screen is collapsed in retracted position.

13 Claims, 5 Drawing Sheets

RETRACTABLE FENCE SYSTEM FOR SWIMMING POOL OR THE LIKE

BACK GROUND OF THE INVENTION (a) Field of the Invention

The present invention relates to a retractable fence for a swimming pool or the like. More particularly, the invention is concerned with a fence which is movable between a retracted position inside a trench and an upstanding extended position when it can be used to prevent trespassing.

(b) Description of the Prior Art

Because of the dangers associated with a swimming pool, especially when the latter is left without surveillance if small children wander in the area where the pool is located, municipal by-laws nearly always require that the pool be enclosed within a fence. Now, in many cases, this is undesirable since the fence is often unattractive and may also block the view to a nice scenery, such as in mountain areas or along the shores of a lake, a river or the like.

Attempts have been made to improve safety around a pool by utilizing s part of the fence as a cover for the pool when the latter is not in use, such as described in U.S. Pat. Nos. 3,094,710 and 3,227,422. These systems are complicated and, to say the least, they are not esthetically acceptable. There is thus a need for a system which remains attractive to the eye, provides fence protection when necessary and is easy to install and operate.

It is therefore an object of the present invention to provide a fence for swimming pools or the like which may easily be raised around or in front of an area and caused to be retracted when not needed.

SUMMARY OF THE INVENTION

According to the invention there is provided a fence which is movable between a retracted and an extended position and that can be used around a pool or the like to prevent trespassing when in extended position, a trench being provided for the fence. The fence comprises a collapsible screen having a lower part and an upper part, means for mounting the lower part of the collapsible screen in the trench, means engaging the upper part of the screen, means operable to cause the engaging means to raise the upper part of the collapsible screen to an extended position at a predetermined height above the trench, and to lower same to retracted position inside the trench, and a closure for the trench when the screen is in retracted position.

The screen is preferably rectangular, and may consist of at least one rectangular piece of cloth. Of course, any other suitable material such as plastic, net, vinyl, and the like may also be used.

According to an embodiment, the fence comprises a plurality of lifting rods, one being provided for both lateral ends of the rectangular screen, means to engage the upper part of the screen between the upper extremities of two lifting rods provided at the lateral ends of the rectangular frame, and means enabling the lifting rods to project upwardly from and to withdraw downwardly into the trench.

According to another embodiment, cavities are provided at the bottom of the trench to receive the lifting rods when they are in retracted position. The fence system may also comprise a plurality of cylinders, preferably hydraulic cylinders, which are disposed in the cavities, the lifting rods being operated by the cylinders.

According to yet another embodiment, the closure may comprise an elongated plate dimensioned to fit over the trench and a hinge arranged to articulate the plate along one longitudinal edge of the elongated plate.

The fence may also comprise a lever which is pivotally mounted at an upper end on the underface of the closure plate and is pivoted at the lower end inside the trench.

In accordance with yet another embodiment, the screen comprises a plurality of transverse guiding rods including a bottom rod, a top rod and intermediate rods. The cloth wraps around the guiding rods, and the latter are designed to maintain the screen substantially along a vertical plane when the screen is allowed to collapse. Although, it is not absolutely essential, the guiding rods are normally equidistant.

According to yet another embodiment, the fence according to the invention may comprise a pair of scissors jacks for each rectangular piece of cloth. The scissors jack has a base fixed at the bottom of the trench, a plurality of intermediate articulations, a top articulation, and a plurality of lateral joints. The intermediate guiding rods are fixed at the intermediate articulations, the top guiding rod is fixed at the top articulation and has ends engaged in shoulders provided at the top of each lifting rod, and the bottom guiding rod is fixed at the base of the scissors jack.

According to the invention, the lever which is used to articulate the closure plate may be fixed at its lower end to the lowermost joint of the scissors jack so as to open the closure plate when extending the scissors jack and close the closure plate when retracting the scissors jack.

According to an alternative embodiment, the screen comprises a rectangular piece of cloth which has its upper end fixed to a slat and its lower end wound over a winding roller, the slat having both ends fixed to shoulders provided at the upper ends of the lifting rods. The winding roller is freely ratatable between brackets fixed at the bottom of the trench. A sleeve is provided which is slidable along each lifting rod and a coil spring is mounted around each lifting rod between the sleeve and the top of the cylinder. The lever is also mounted at its lower end on the sleeve, so that when the lifting rod is extended, the coil spring causes the sleeve to slide upwardly to open the closure plate.

BRIEF DESCRIPTION OF THE DRAWINGS

The above and other objects of the present invention will become apparent from the description which follows of preferred embodiments when read in conjunction with the annexed drawings in which.

DESCRIPTION OF THE PREFERRED EMBODIMENTS

Figure 1:
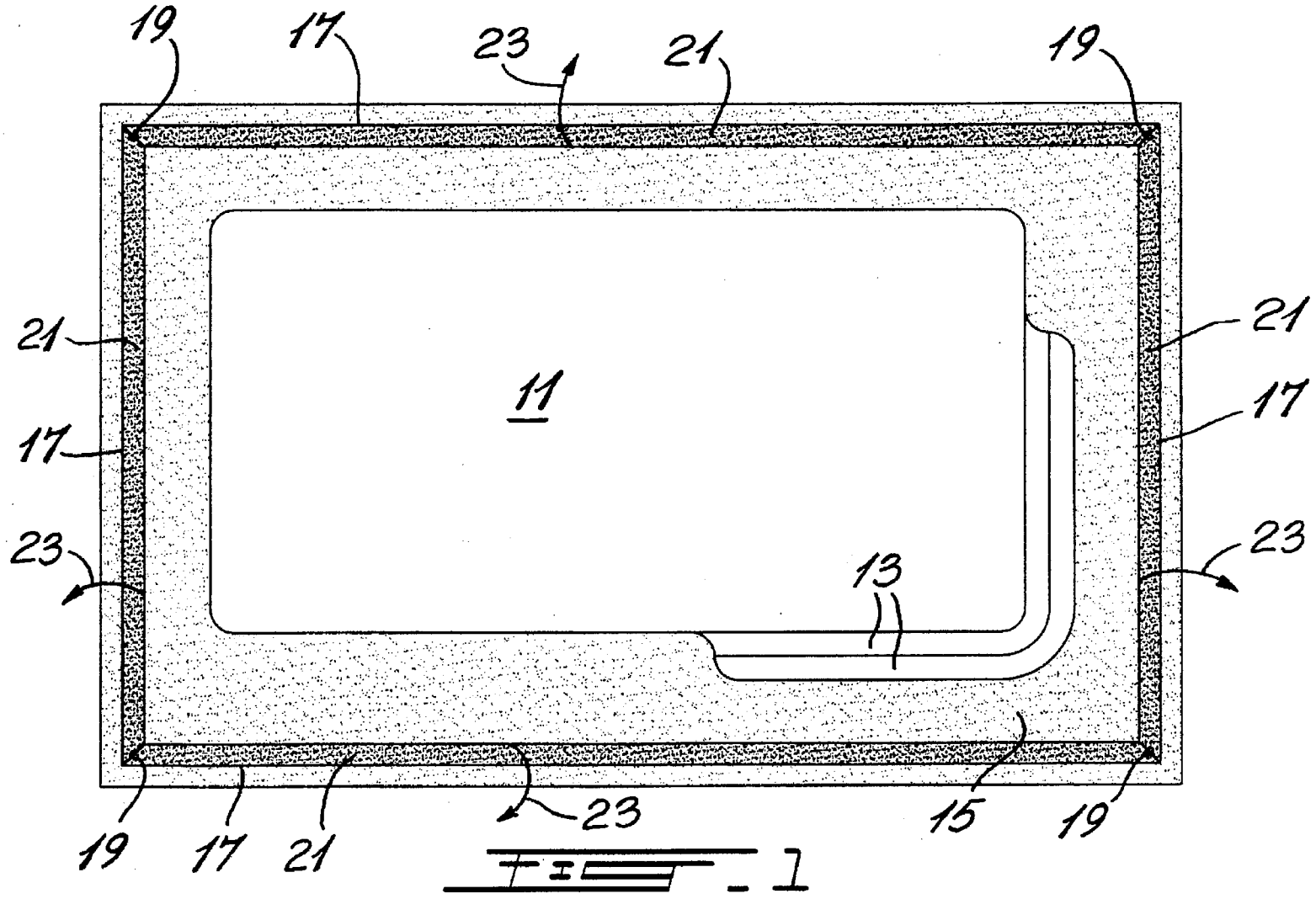
FIG. 1 is a view from the top of a swimming pool provided with a fence system according to the invention, the fence being in retracted position.

Referring first to FIG. 1, there is illustrated a standard rectangular pool 11 having steps 13 and surrounded by pool deck 15. Around deck 15, there is a fence system 17 according to the invention, in a retracted position. Operation of the fence system 17 is carded out by means of hydraulic cylinders 19 which are here schematically illustrated at the four comers. As illustrated in FIG. 1, the fence is retracted and is concealed in a trench, which will be described later, by means of pivoting closure plates 21. Four such plates are illustrated. However, it will be realized that any number of closure plates and consequently of fence sections may be used as will be appreciated by one skilled in the art. Also as shown, the closure plates are designed to pivot in the direction indicated by arrows 23, although as will be appreciated pivoting in the opposite direction would be possible for design purpose.

Figure 2:
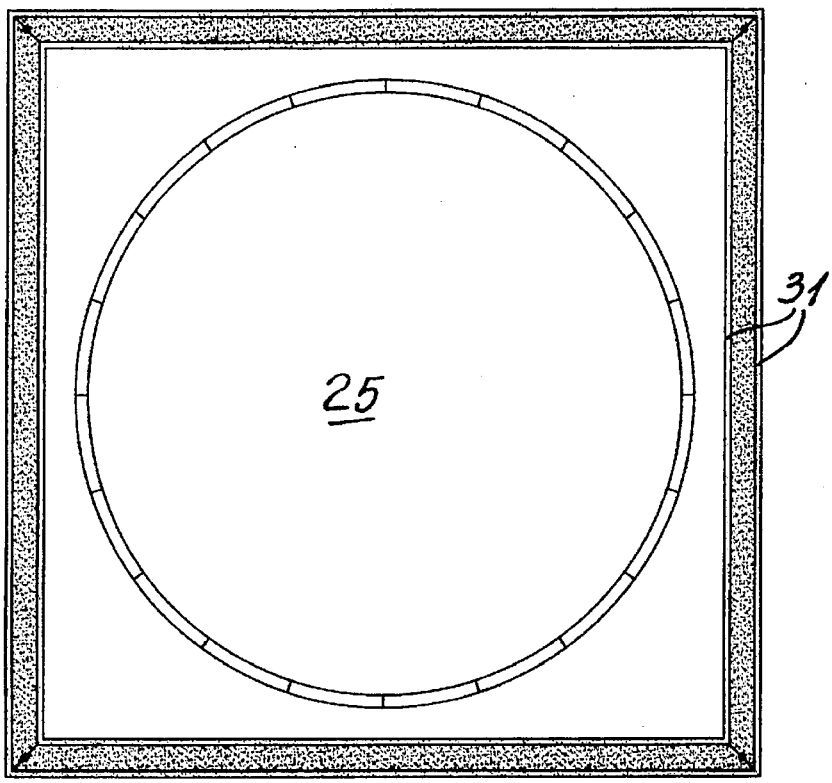
FIG. 2 is another top view illustrating an above ground pool provided with a system according to the invention, also with the fence being retracted.

FIG. 2 illustrates a similar system, except that it is arranged for mounting around an above ground circular pool 25.

Figure 3:
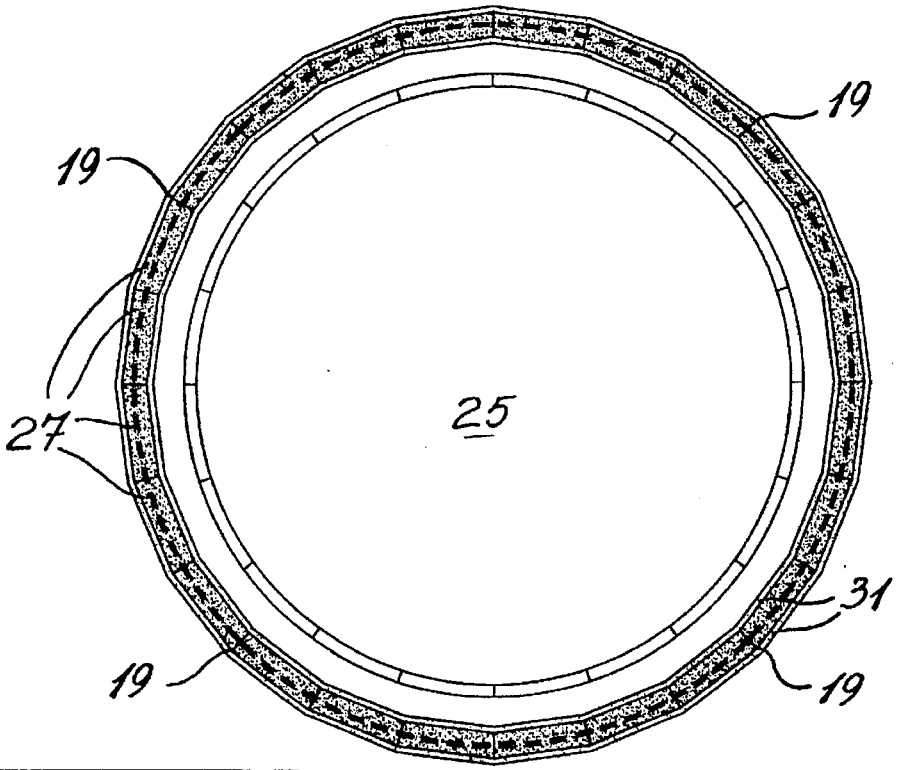
FIG. 3 is another top view of an above ground pool wherein the fence is polygonal.

Turning now to FIG. 3, there is shown a modified fence system for an above ground circular pool 25 wherein the fence system is polygonal. In this case, instead of providing long closure plates 21 as in FIGS. 1 and 2, the closure plates consist of short sections 27 which overlap one another at their ends, so that as one section is being pivoted, this will carry the next one, and so forth. In other words, a predetermined number of hydraulic cylinders (not shown) are provided, and each is pivotably connected to a short section to open same when extending the cylinder. The overlapping mounting of a number of sections will cause a certain number to be opened by the action of a specific hydraulic cylinder.

For a description of the mechanism used to operate a fence system according to a preferred embodiment according to the invention, reference will be made to FIGS. 4 and 6 of the drawings. As shown, all around the pool, there is a trench 29 in which there is disposed a rectangular casing 31 which may be metallic or made of any other suitable material such as PVC, fiberglass, concrete and the like as it is well known to those skilled in the art. Trench 29 can be closed or opened by means of a closure plate 21 which is articulated along the top edge of one vertical side 33 of casing 21 by means of hinge 35 mounted thereon in a well known manner. In this embodiment, the main material of the fence is a rectangular screen 37 consisting of a piece of cloth. Of course, any other suitable material may be used without departing from the scope and spirit of the invention. At regular or predetermined locations along trench 23, tubular cavities 39 are provided, each of which having its own casing 41 peripherally extending on the vertical walls and also on the bottom thereof. Inside cavity 39, there is a hydraulic cylinder 43 which is mounted vertically therein by having its lower end fixed into a concrete block 44 such as by screwing as shown. Braces or any other means known to those skilled in the art may be used to help maintain the hydraulic cylinder in fixed vertical position.

The piston rod of hydraulic cylinder 43 will hereafter be referred to as a lifting rod 45 in view of the function which is assigned to it. With particular reference to FIG. 6, it will be seen that it is designed to extend from a retracted position as shown in full line to the position illustrated therein in dotted lines, which is the fully extended position. Each is operated in the usual manner, hydraulic fluid being supplied in known manner through ducts 47, 49. For convenience, a double bottom 50 has been disposed in known manner in trench 23 for hiding ducts 47, 49 therein. Finally, the top end of each lifting rod 45 is provided with an engaging shoulder 51 to connect the top of screen 37 thereto as will be discussed later.

Referring again to FIGS. 4 and 6, it will be seen that in addition to cloth material, screen 37 comprises a plurality of transverse guiding rods, here six although this number may vary to a large extent, including bottom rod 52, top rod 53 and intermediate rods 54. As shown, the cloth material wraps in known manner around all the transverse guiding rods 52, 53 and 54. It will readily appear to anyone that the rods are designed mostly to maintain the screen substantially vertical especially when it is allowed to collapse when retracting the lifting rods 45. For a proper operation when retracting the screen, the rods are normally equidistant, although this is not absolutely essential.

The main operation of extending or retracting the screen is the result of a combined operation of lifting rod 45 and scissors jack 55 which will now be described. Referring again to FIGS. 4 and 6, it will be realized that scissors jack 55 has a base 57 which is fixed in known manner against double bottom floor 50. In the usual manner, scissors jack 55 has intermediate articulations 59, a top articulation 61 and lateral joints 63 all as particularly shown in FIG. 4. Intermediate guiding rods 54 are fixed in known manner near the ends thereof at the intermediate articulations 59 between two identical adjoining scissors jacks 55 as particularly shown in FIG. 6. The same mounting takes place at bases 57 of adjoining scissors jacks which engage bottom guiding rod 52. With respect to top guiding rod 53, in addition to being engaged by top articulations 61, the ends are fixedly mounted on shotriders 47, as particularly shown in FIG. 6.

Figure 4:
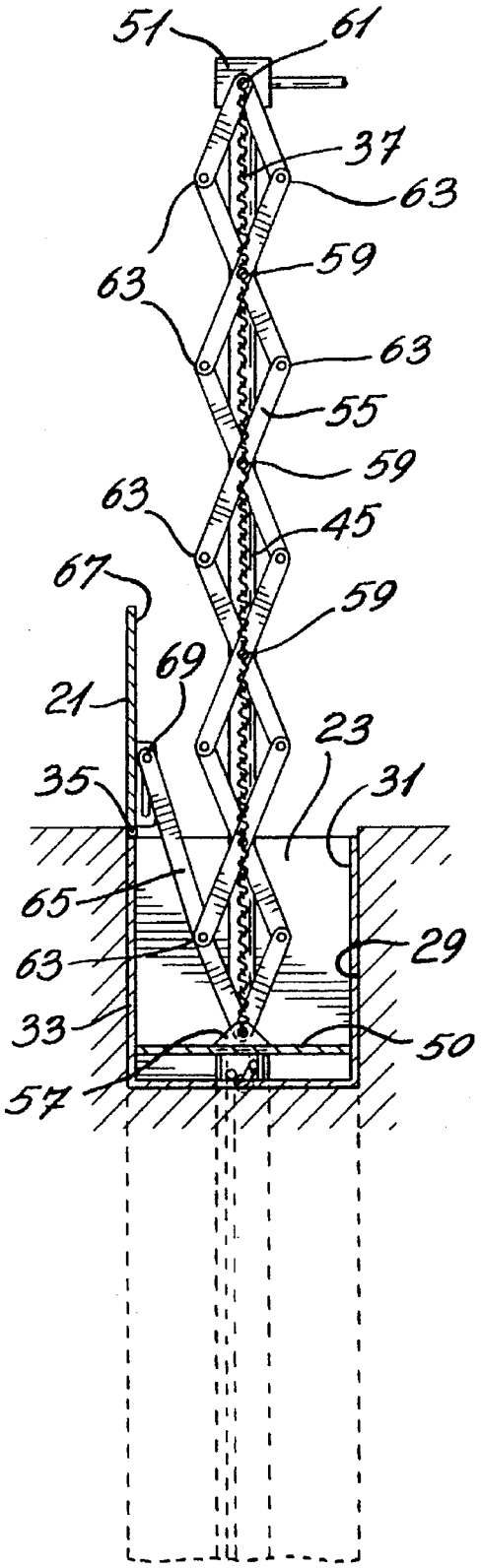
FIG. 4 is a cross-section view illustrating a mechanism for extending or retracting a fence according to the invention.

Referring now to FIG. 4, it will be seen that a lever 65 is mounted in known manner to pivot at one lowermost lateral joint 63 at the lower end and at the underface 67 of closure plate 21, particularly at 69. With this arrangement, when retracting lifting rod 45, this will carry scissors jack 55 and cause closure plate 21 to articulate in closed position.

By providing a suitable control for the hydraulic system, the fence system according to the invention will easily be extended or retracted at the touch of a button and closure plate 21 will constitute a convenient concealment of all the parts of the fence system.

Figure 5:
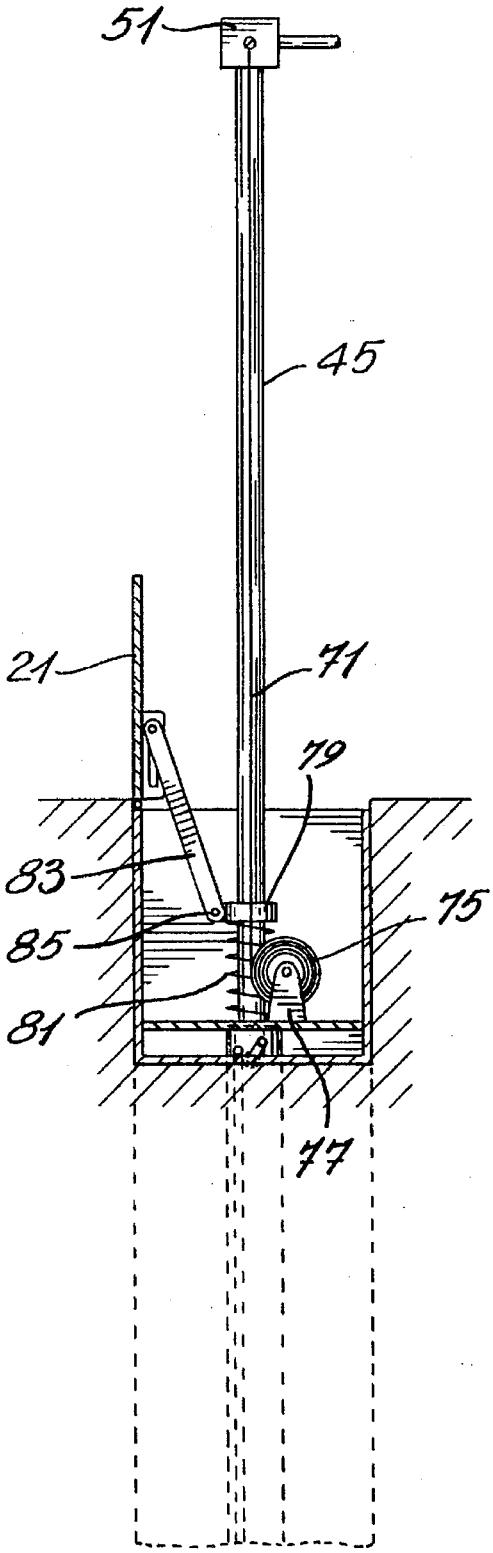
FIG. 5 is a cross-section view of a mechanism according to another embodiment.
Figure 6:
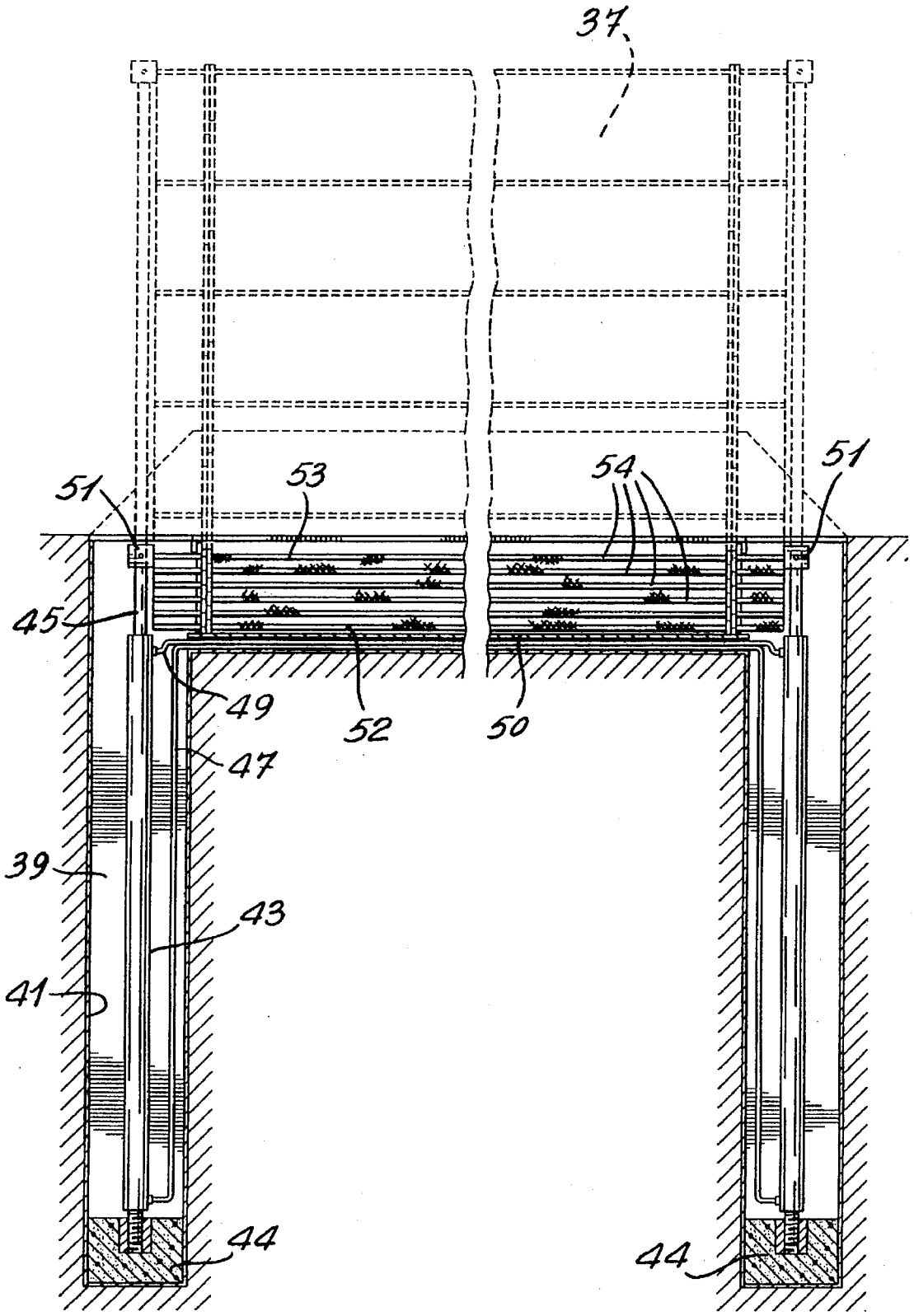
FIG. 6 is a cross-section view showing the operation of the mechanism illustrated in FIG. 4.
Figure 7:
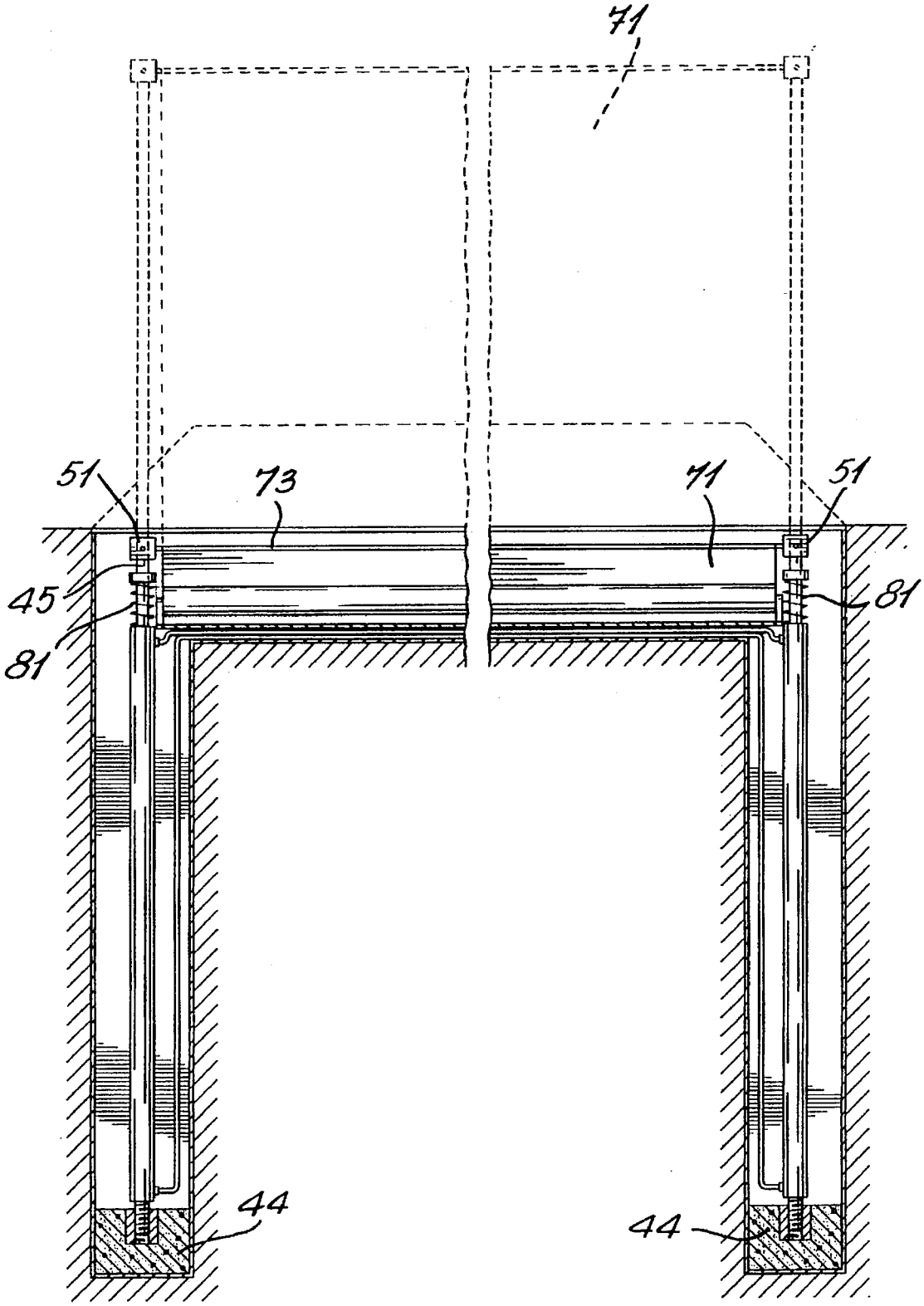
FIG. 7 is a cross-section view showing the operation of the mechanism illustrated in FIG. 5.

An alternative to the fence system illustrated in FIGS. 4 and 6 is shown in FIGS. 5 and 7 where like parts will be identified by corresponding reference numerals.

In this case, the upper end of rectangular cloth 71 is fixed to slat 73 which has both ends fixed in known manner to shoulders 51 of two adjoining lifting rods 45. The lower end of rectangular cloth 71 is wound over winding roller 75 which is freely rotatable between brackets 77 fixed in known manner against double bottom 50. It will also be seen that a sleeve 79 is slidably mounted along lifting rod 45, as shown, and that a coil spring 81 is mounted around each lifting rod 45 between sleeve 79 and the top of each cylinder 45. A lever 83, similar to lever 65, is mounted in known manner to pivot at the underface of closure plate 21 and at a pivot point 85 provided on sleeve 79. In this manner, when the lifting rods 45 which hold screen 71 are extended, coil springs 81 cause sleeves 79 to slide upwardly to open closure plate 21 through lever 83.

It is understood that modifications are possible without departing from the scope of the present invention. For example, the invention applies to any kind of fence. Also, other types of lifting may be provided for extending or reducing the fence.

I claim:

1. A fence system which is movable between a retracted and an extended position and that can be used around a pool to prevent trespassing when in said extended position, a trench being provided for said fence system, said fence system comprising a collapsible rectangular screen having a lower part and an upper part, means for mounting the lower part of said collapsible screen in said trench, means engaging the upper part of said screen, means operable to cause said engaging means to raise said upper part of said collapsible screen to said extended position at a predetermined height above said trench, and to lower same to said retracted position inside said trench, said engaging means comprising a plurality of lifting rods one said lifting rod being provided for both lateral ends of said rectangular screen, means to engage the upper part of said screen between upper extremities of the two lifting rods provided at said lateral ends of said rectangular screen, and means enabling said lifting rods to project upwardly from and to withdraw downwardly into said trench, and a closure for said trench when said screen is in said retracted position.

2. A fence system according to claim 1 wherein said screen consists of at least one rectangular piece of cloth.

3. A fence system according to claim 1 wherein cavities are provided at the bottom of said trench to receive said lifting rods when the latter are in said retracted position.

4. A fence system according to claim 3 which comprises a plurality of cylinders, one said cylinder disposed in each said cavities, said lifting rods being operated by said cylinders.

5. A fence system according to claim 4 wherein said cylinders are hydraulic cylinders.

6. A fence system according to claim 5 wherein said closure comprises an elongated plate dimensioned to fit over said trench and a hinge arranged to articulate said plate along one longitudinal edge thereof.

7. A fence system according to claim 6, which comprises a lever pivotally mounted at an upper end thereof on underface of the closure plate and pivoted at a lower end thereof inside said trench.

8. A fence system according to claim 7 wherein said screen comprises a plurality of transverse guiding rods including a bottom rod, a top rod and intermediate rods, said cloth wrapping around said guiding rods, said guiding rods designed to maintain said screen substantially along a vertical plane when said screen is allowed to collapsed.

9. A fence system according to claim 8 wherein said guiding rods are equidistant.

10. A fence system according to claim 8 which comprises a pair of scissors jacks for each rectangular piece of cloth, said scissors jack having a base fixed at the bottom of said trench, a plurality of intermediate articulations, a top articulation, and a plurality of lateral joints, said intermediate guiding rods being fixed at said intermediate articulations, said top guiding rod fixed at said top articulation and having ends engaged in shoulders provided at the top of each lifting rod, said bottom guiding rod fixed at the base of said scissors jack.

11. A fence system according to claim 10 wherein said lever is fixed at its lower end to said scissors jack at a lowermost joint thereof, so as to open said closure plate when extending said scissors jack and close same when retracting it.

12. A fence system according to claim 7 wherein said screen comprises at least one rectangular piece of cloth, said rectangular piece of cloth has its upper end fixed to a slat and its lower end wound over a winding roller, said slat having both ends fixed to shoulders provided at the upper ends of said lifting rods, said winding rollers freely rotatable between brackets fixed at the bottom of said trench, a sleeve slidable along each said lifting rod and a coil spring mounted around each said lifting rod between said sleeve and the top of said cylinder, said lever being also mounted at its lower end on said sleeve, so that when the lifting rod is extended, said coil spring causes said sleeve to slide upwardly to open said closure plate.

13. A fence system according to claim 1 wherein said closure consists of a plurality of closure plate sections, each overlapping end to end so as enable one closure plate section to open adjacent plate sections when said one closure plate is being opened.

* * * * *